United States Patent [19]

Arima et al.

[11] 4,295,882

[45] Oct. 20, 1981

[54] STEEL MAKING PROCESS

[75] Inventors: Ryoji Arima, Kobe; Kazushige Umezawa; Tokuzo Nisugi, both of Himeji, all of Japan

[73] Assignee: Nippon Steel Corporation, Tokyo, Japan

[21] Appl. No.: 85,255

[22] Filed: Oct. 16, 1979

[30] Foreign Application Priority Data

| | | | |
|---|---|---|---|
| Oct. 24, 1978 | [JP] | Japan | 53-130039 |
| Nov. 2, 1978 | [JP] | Japan | 53-134584 |
| Dec. 15, 1978 | [JP] | Japan | 53-154769 |
| Dec. 30, 1978 | [JP] | Japan | 53-162538 |
| Dec. 30, 1978 | [JP] | Japan | 53-162539 |
| Jan. 13, 1979 | [JP] | Japan | 54-1780 |

[51] Int. Cl.[3] ..... C21C 7/02

[52] U.S. Cl. ..... 75/52; 75/58; 75/60; 75/257

[58] Field of Search ..... 75/52, 51, 58, 60, 257

[56] References Cited

U.S. PATENT DOCUMENTS

| | | | |
|---|---|---|---|
| 2,693,411 | 11/1954 | Cremer | 75/46 |
| 3,153,602 | 10/1964 | Duckett | 75/257 |
| 3,843,354 | 10/1974 | Nilles | 75/52 |
| 4,036,635 | 7/1977 | Klapdor | 75/58 |

FOREIGN PATENT DOCUMENTS

| | | | |
|---|---|---|---|
| 924452 | 3/1955 | Fed. Rep. of Germany | 75/60 |
| 1013306 | 8/1957 | Fed. Rep. of Germany | 75/60 |
| 1433416 | 11/1968 | Fed. Rep. of Germany | 75/60 |
| 76918 | 11/1961 | France | 75/60 |
| 31463 | 3/1953 | Luxembourg | 75/60 |
| 705321 | 3/1954 | United Kingdom | 75/60 |
| 718001 | 11/1954 | United Kingdom | 75/60 |

OTHER PUBLICATIONS

Huttenwerk Oberhausen AG, Technishe Berichte, pp. 1–2 (1951/1954).

*Primary Examiner*—P. D. Rosenberg

*Attorney, Agent, or Firm*—Cushman, Darby & Cushman

[57] ABSTRACT

Molten steel in desiliconized, dephosphorized and decarburized in a three-step sequence. In the first-two steps the melt is agitated. In the first step the temperature is also maintained at between 1480°–1380° C. while oxygen is introduced until the silicon content is reduced to 0.20%. In the second step a flux consisting essentially of CaO and 0.2–0.5 parts by weight of $CaCl_2$ and/or KCl is introduced while maintaining the basicity of the slag at between 3.5–8.0 and the T.Fe value at between 3–10%. The third step involves blowing oxygen onto this melt without using a refining flux.

16 Claims, 6 Drawing Figures

STEEL MAKING PROCESS

BACKGROUND OF THE INVENTION

1. Field of the Invention

This invention relates to a process for converting molten iron from a blast furnace into molten steel. The process provides an improved refining which comprises a systematic division of the sequence of treating molten iron.

2. Description of the Prior Art (1) A typical example of the process for converting molten iron from a blast furnace into molten steel is the basic oxygen converter process which comprises blowing oxygen onto the molten iron in the presence of basic slag to achieve simultaneous reduction of the C, Si, P and S contents of the melt to the desired levels. However, the onverter process involves oxidation reaction which performs decarburization, desiliconization and dephosphorization simultaneously in the converter, and accordingly, high bath and atmospheric temperatures are generated. The dephosphorization reaction proceeds at relatively low temperatures, and to accomplish efficient dephosphorization, the slag formation must be controlled while its basicity is held high. However, due to desiliconization, silicon is oxidized earliest into silicic anhydride ($SiO_2$) which thereby reduces the basicity of the slag and inhibits dephosphorization. Therefore, to achieve the proper control of the slag basicity, much flux such as CaO is needed, and this results in the formation of as much as 120 to 150 kg/t of slag. Steel making operations in the presence of much slag often cause slag foaming or slopping, and to prevent such unwanted phenomena, a large-capacity converter must be used, resulting in an increase in the cost of the stell mill. Besides, the discharge of much slag increases the load and operating cost of a recovery or regenerating system, and in addition, the limited use of slag makes a large slag dumping yard necessary. The formation of much slag also means low iron yield because slag contains about 20% of FeO. (This includes a little $Fe_2O_3$). What is more, the high slag content causes early damages to the furnace refractory and complicates the converter operation, causing various problems such as low quality molten steel due to its absorption of hydrogen from the flux and to its increased oxygen content as well as the need of adition of ferroally and low steel yield.

(2) The process of performing desulfurization and dephosphorization in two separate stages has been proposed in, for example, Japanese Patent Publication No. 42696/71. The basic concept of the process is to remove impurity elements such as Si, P and S prior to decarburization by blowing oxygen gas. However, the prior art reference does not teach desiliconization effected before desulfurization and dephosphorization. Instead, the reference indicates simultaneous occurence of desiliconization with dephosphorization which follows desulfurization and is performed in the presence of an oxidizer. Dephosphorization requires the basicity to be held at a predetermined level, but since the molten iron is yet to be desiliconized, all of the silica source is carried over into the dephosphorization step, thus requiring a sufficient amount of flux to achieve the desired silica removal, and therefore, the amount of slag formed in the process is not appreciably smaller than that formed in the converter process. In addition, the question arises as to which treatment should be combined with which (e.g. desiliconization-desulfurization, or dephosphorization-decarburization). One of the critical factors to be considered in solution of the question is that of heat balance. How can a high level of C content in the molten iron be maintained in the treatment that precedes decarburization if it is to serve as a heat source in decarburization? Because of these yet to be solve problems, the described process of performing desulfurization and dephosphorization separately is not being operated on an industrial scale.

SUMMARY OF THE INVENTION

Therefore, the primary object of this invention is basically to provide a steelmaking process, wherein the individual divided steps are combined systematically to minimize slag formation, thereby solving all problems derived from slag.

This object and accompanying advantages of this invention are accomplished by any one of the following processes.

1. A steelmaking process for desiliconizing, dephosphorizing, desulfurizing and decarburizing molten iron from a blast furnace, comprising the sequence of the following steps:

(1) the first step of agitating or stirring the molten iron in a reaction vessel, supplying the molten iron with both gaseous oxygen and solid oxygen, e.g. iron oxides such as FeO and $Fe_2O_3$ reducing the Si content of the iron from above 0.20%, e.g. 0.3% to 0.8%, to a value between 0.05 and 0.20% at a controlled bath temperature between 1480° and 1380° C., and cutting off the resulting slag;

(2) the second step of agitating or stirring the molten iron from the first step having a bath temperature between 1480° and 1380° C., supplying the molten iron with a flux mainly consisting of CaO and 0.2 to 0.5 parts by weight of $CaCl_2$ or KCl or both $CaCl_2$ and KCl per part by weight of CaO and a source of oxygen, maintaining the basicity (ratio of $CaO/SiO_2$ by weight) of the processing slag between 3.5 and 8.0 and the T. Fe (Total Fe) level between 3 and 10%, desulfurizing and dephosphorizing the iron with the same slag to reduce the P, S and Si contents to not higher than 0.025%, 0.020% and a trace, respectively, and to hold the C content not lower than 3.8% and cutting off the resulting slag; and (3) the third step of decarburizing the molten iron from the second step by blowing oxygen onto the melt without using a refining flux.

2. A process according to Paragraph 1 wherein the source of oxygen used in the second step consists of both gaseous oxygen and solid oxygen.

3. A process according to Paragraph 1 wherein the charge of said flux used in said second step is in the range of from 12 to 30 kg per ton of molten iron.

4. A process according to Paragraph 1 wherein said oxygen source is supplied continuously or portionwise to control the T.Fe level of the processing slag in said second step.

5. A process according to Paragraph 1 wherein the processing slag has a basicity between 4 and 6 in said second step.

6. A process according to Paragraph 1 wherein the gaseous oxygen used in the second step is blown onto the surface of the processing slag to perform evaporative desulfurization.

7. A process according to Paragraph 1 wherein the molten iron is agitated or stirred in the second step while a flux mainly consisting of CaO and $CaCl_2$ or KCl, or both $CaCl_2$ and KCl is supplied to the molten iron to perform desulfurization first, followed by dephosphorization occurring simultaneously with evaporative desulfurization of the processing slag.

8. A process according to Paragraph 1 wherein gaseous oxygen is softblown onto the surface of molten iron bath in the third step and an agitating or stirring gas is supplied from the bottom of the bath.

9. A process according to Paragraph 8 wherein in the third step, the vessel is charged with molten iron that accounts for 25 to 60% of the vessel capacity.

DETAILED DESCRIPTION OF THE INVENTION

Figure 1:
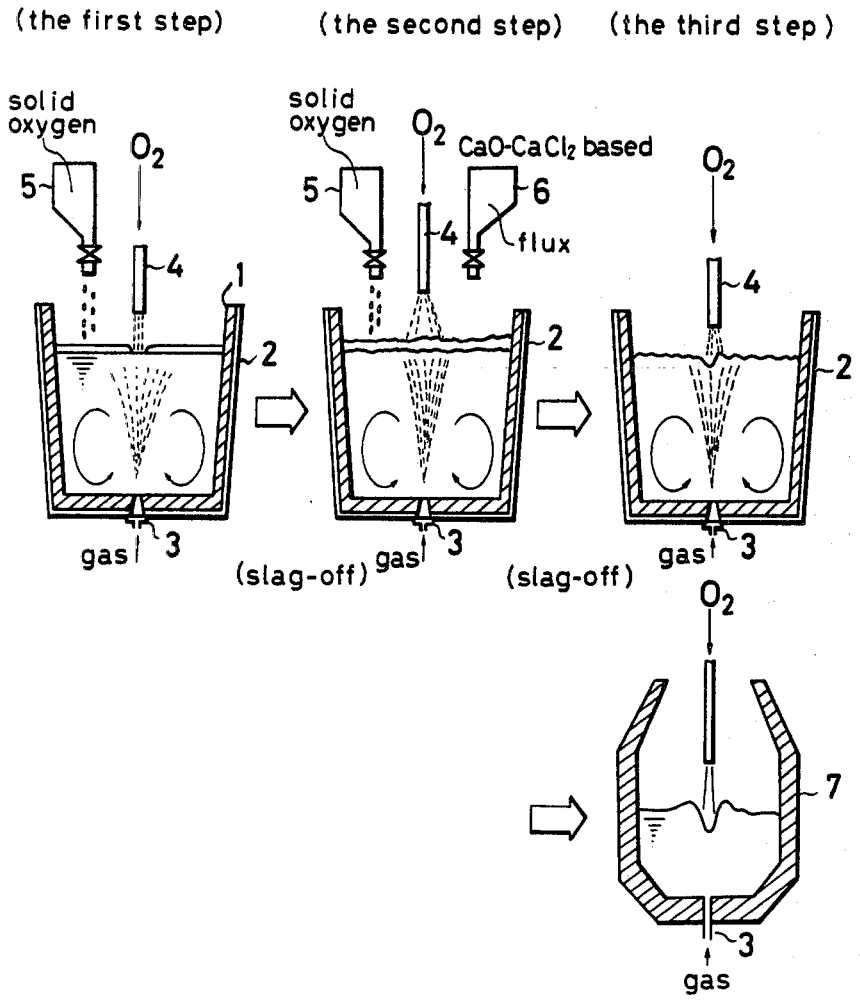
FIG. 1 illustrates an outline of the sequence of steelmaking according to this invention.

The process of this invention is now described in detail. Four reactions occur during the refining of molten iron. They are decarburization, desiliconization, dephosphorization and desulfurization; the first three reactions take place in the conventional LD converter, and desulfurization of molten iron is in many cases performed before it is charged into the converter. Decarburization is a gas-liquid reaction where only oxygen gas reacts with molten iron, and theoretically, the reaction proceeds more smoothly in a high temperature range than in a low temperature range. On the other hand, desiliconization, dephosphorization and desulfurization are a liquid-liquid reaction where slag reacts with molten iron, and to promote dephosphorization particularly and minimize the slag-induced wearout of the furnace refractory, these reactions are advantageously carried out in a low temperature range. In consideration of these facts, complete separation of decarburization from the other reactions will permit the most efficient refining. However, this object cannot be attained without reaching the following targets:

(1) Refining of molten iron a low temperature range isolated from decarburization is such that the P, S and Si contents have been reduced to the levels required for a steel object;

(2) The molten iron with reduced P, S and Si contents can be decarburized involving only a gas-liquid reaction, that is, without forming slag;

(3) In consequence of optimized division of the refining reaction into the above two steps, an appreciable decrease in the processing slag is realized in the first step and a decrease in iron loss is achieved in the second step through efficient decarburization.

As a result of various studies on the most advantageous performance of these steps, the inventors of this invention have found that the following three requirements must be met to realized efficient dephosphorization and desulfurization which are considered most difficult of the reactions to occur in the first step:

(a) CaO-based processing slag has a basicity ($CaO/SiO_2$) controlled at not lower than 3.5;

(b) the T.Fe level of the slag is held at 3 to 10%;

(c) the processing slag satisfying the requirements (a) and (b) is forcibly agitated or stirred in a batch vessel to provide intimate contact between the slag and the metal.

Now, dephosphorization is generally an oxidizing reaction, whereas desulfurization is a reducing reaction. For example, to accelerate dephosphorization occuring in a converter, the T.Fe level of processing slag must be generally increased to a range of 20 to 40% but in this range, desulfurization barely proceeds. On the other hand, the lower the T.Fe level, the faster the desulfurization proceeds, and therefore, it is conventionally performed in a reducing atmosphere as a separate pretreatment of molten iron.

However, the inventors of this invention have found that in case high-basicity slag mainly consisting of CaO is brought into contact with the metal under forced agitation or stirring, it becomes possible to perform dephosphorization even if the slag has a FeO content by far lower than the conventionally required level. Because of the reduced FeO content in the slag, simultaneous dephosphorization and desulfurization that has been impossible with the conventional converter process and the process of Japanese Patent Publication No. 42696/71 can now be performed at an accelerated rate with a small amount of processing slag whose composition is common to both reactions. However, if the processing slag has high basicity and a low T.Fe level and if it is used in a low temperature range, it does not form a melting slag or the resulting slag has only low fluidity, and therefore, such slag is not acceptable in practical operations. Many attempts have been made to avoid these disadvantages by performing pre-refining at a basicity lower than 3.0, but all of them require a large volume of processing slag to be added and therefore fail completely to attain the object of this invention to reduce the amount of the necessary processing slag. An increase in the FeO content in the processing slag may improve its fluidity, but then this is accompanied with not only low desulfurizing effect but increased oxygen potential of the slag, and as a result, the C content is reduced to such degree that the performance of the process of this invention is not only impossible but also foaming of slag occurs to make the operation of the process difficult. To solve these problems, according to this invention, a melting point depressant comprising $CaCl_2$ or KCl, or both $CaCl_2$ and KCl is added in an amount of 0.2 to 0.5 parts by weight per one part by weight of CaO and the temperature for initiating dephosphorization and desulfurization is kept higher than 1380° C. The result is formation of slag having higher basicity and low FeO content. One critical factor for controlling the T.Fe level of processing slag within a very narrow range (3 to 10%) under forced agitation or stirring of high-carbon molten iron is the method of supplying solid oxygen (iron oxides), and this invention attains the intended control of T.Fe level by supplying solid oxygen continuously or portionwise. A shorter processing time is required for realizing steelmaking operations on an industrial scale. The processing time is governed primarily by the reaction time of dephosphorization and desulfurization, which in turn is controlled by the force of agitating or stirring slag and metal. To provide an agitating or stirring force effective for shortening the reaction time, an agitating energy of say, 0.3 kw/t-pig is necessary, and this demand is met in this invention by charging molten iron into a batch vessel and carrying out forced agitation or stirring by means of gas blowing, an impeller, or other suitable means. Such forced agitation or stirring is very difficult in the conventional continuous steelmaking process. As set forth above, this invention requires processing slag to have a basicity in the range of from 3.5 to 8, and to reduce the volume of the processing slag to the minimum required level under this condition, the silica source in the molten iron must be decreased. This is why in the process of this invention, dephosphorization and desulfurization comes after desiliconization which reduces the Si content to no higher than 0.20%.

Carbon is the only source of heat to be used in decarburization of this invention and hence its content must be held as high as possible. To achieve this objective, desiliconization is first carried out at a temperature not higher than 1480° C. to thereby inhibit the possible occurrence of decarburization, and in the subsequent dephosphorization and desulfurization, only a small amount of iron oxides is added to thereby hold the FeO content in the processing slag low and prevent decarburization. By treating molten iron under these conditions, the carbon content of the iron before carburization can be held at 3.8% or more.

In the pages that follow, the sequence of the process of this invention will be specifically described.

The first step

The primary purpose of the first step according to this invention is desiliconization. This invention employs molten iron produced in a blast furnace. The composition of the melt varies depending upon the raw materials charged in the furnace and the operating conditions of the furnace, and it generally contains 4.3–4.7% C, 0.3–0.8% Si, 0.4–0.9% Mn, 0.080–0.200% P and 0.015–0.050% S. According to this invention, such molten iron is transferred into a vessel such as ladle, where it is subject to the treatment of reducing silicon which is described hereunder.

As is clear from the left drawing in FIG. 1 that illustrates the first step of the process of this invention, the ladle is a vessel lined with a refractory layer 1 commonly employed in steelmaking, and the vessel is generally indicated at 2. The ladle 2 is equipped with a conventional device 3 for blowing an agitating or stirring gas from the bottom. The gas blowing means may comprise a porous plug or a gas supply pipe or a refractory pipe which is to be immersed in the ladle from above. The gas which is introduced into the ladle through the gas blowing device 3 is generally argon gas, nitrogen gas or other inert gases, but oxygen gas can also be used. Depending on the purpose, these gases may be mixed with a substance such as iron oxides. Agitation or stirring by gas may be replaced by suitable mechanical agitation or stirring.

The ladle 2 equipped with the gas blowing device 3 is charged with molten iron of the composition defined above and having a temperature of, say, 1400° C. Basically, the desiliconization of this invention is performed by supplying oxygen to the molten iron; the silicon in the iron (or the Si content) is then oxidized to $SiO_2$ and slag mainly consisting of $SiO_2$ floats on the surface of the bath and is discharged from the ladle. To have the desiliconization predominate over other reactions and let it proceed efficiently, the efficiency of contact between the silicon in the iron and oxygen is enhanced by making use of the agitating or stirring force of the gas being supplied from the blowing device 3.

The most characteristic feature of the desiliconization of this invention consists in reducing the Si content to a range of from 0.05 to 0.20% with the bath temperature being controlled between 1380° and 1480° C. Supplying the molten iron bath with oxygen causes the silicon in the iron to be oxidized to $SiO_2$. If the oxygen supplied is gaseous oxygen, for instance, industrial high-purity oxygen gas, rapid oxidation of silicon gives off heat the elevates the bath temperature. If the bath temperature exceeds 1480° C., the rate of oxidation of the imprisoned carbon is increased and the absolute quantity of carbon that works as the only source of fuel to be used in the third step of this invention, i.e. decarburization, is decreased, and this results in limited ability to consume scrap in the decarburization. Therefore, this invention carries out desiliconization while the bath temperature is controlled at no higher than 1480° C. so as to inhibit decarburization. As the optimum means for holding the bath temperature no higher than 1480° C., this invention supplies the molten iron bath with not only gaseous oxygen but also solid oxygen having both oxidizing and cooling capabilities. Examples of the solid oxygen are iron ore, iron-manganese ore, scales and iron oxides which may be used independently or as a mixture.

In the left drawing in FIG. 1 which illustrates the first step of the process of this invention, 4 is a lance for supplying gaseous oxygen and 5 is a hopper for supplying solid oxygen. Supplying both gaseous oxygen and solid oxygen helps achieving the intended control of the bath temperature and forms a slag layer on the surface of the bath. The slag mainly consists of $SiO_2$ and FeO (containing $Fe_2O_3$). By agitation or stirring with gas as described above, the FeO ($Fe_2O_3$) is brought into contact with the imprisoned silicon to promote oxidation of silicon, or reduction of FeO, which decreases the FeO content in the slag to inhibit the increase in the amount of slag being formed during desiliconization. A small amount of CaO may be added to increase the fluidity of the processing slag and to thereby achieve a further decrease in the FeO content.

The effects of controlling the bath temperature to no higher than 1480° C. are not limited to the above described inhibition of decarburization. Another effect is that it provides a bath temperature suitable for the treatment in the second step which will be described later. To state briefly, the desulfurization and dephosphorization of iron molten in the second step is desirably performed at the lowest possible temperature since the lower the bath temperature, the higher the equilibrium constant value of dephosphorization, and accordingly, defining the upper limit of the bath temperature at 1480° C. is critical to the second step of this invention. However, because the solid oxygen to be used in the second step has the effect of lowering the bath temperature, the bath temperature should not be made excessively low in the first step. Otherwise, quick dissolution of a flux mainly consisting of CaO and $CaCl_2$ becomes difficult. Therefore, according to this invention, the bath temperature is controlled at 1380° C. or higher in the first step.

As described in the foregoing, the bath being agitated or stirred is supplied with both gaseous and solid oxygen and the bath temperature is controlled between 1380° and 1480° C. so as to perform desiliconization while decarburization is suppressed to a minimum of about 0.2%. If the final Si content after desiliconization exceeds 0.20%, much flux must be used to form processing slag having a basicity ($CaO/SiO_2$) of 3.5 to 8 which is necessary for achieving smooth desulfurization and dephosphorization in the second step. Such increase in the charge of flux results in the increase in the amount of slag discharged, hence is deleterious to the object of this invention.

Therefore, the first step of desiliconization of this invention reduces the Si content of the molten iron to 0.2% or lower while decarburization is inhibited. The lower the Si content, the smaller the amount of flux needed in the second step to attain the intended basicity ($CaO/SiO_2$). However, if the Si content is reduced to less than 0.05%, more decarburization than is permitted proceeds in spite of agitation or stirring of the bath and the control of the bath temperature at 1480° C. or lower, and in consequence, an adequate amount of carbon source cannot be saved for use as the fuel in the third step of decarburization. What is more, due to excessive oxidation of the molten iron, the content of FeO (MnO) in the slag formed in the desiliconization is increased causing greater iron loss.

After completion of the desiliconization of the molten iron in the ladle, the resulting slag that mainly consists of $SiO_2$ is cut off by mechanical arm or dumping, suction or any other conventional means. The amount of the slag discharged corresponds to the decrease in the content of imprisoned silicon. The slag mainly consists of $SiO_2$ and is substantially free of $P_2O_5$, and therefore, it can be regerated for use as a silica source, for example, an additional silica for the materials charged in the blast furnace.

The second step

The primary purposes of the second step of the steelmaking process of this invention are desulfurization and dephosphorization. The step is preferably carried out within the ladle 2 used for desiliconization in the first step; in other words, though the molten iron in the ladle 2 is not transferred to a separate vessel for the second step, it can be treated. This is advantageous in that another ladle need not be preheated and that the possibility of the bath temperature decreasing as a result of reladling is eliminated. In the center drawing of FIG. 1 that illustrates the second step of this invention, 6 is a hopper for supplying a flux which will be described below.

The second step of this invention employs a flux mainly consisting of CaO and $CaCl_2$ or KCl or both $CaCl_2$ and KCl as a composition that helps in desulfurization and dephosphorization of the molten iron. The use of $CaCl_2$ in combination with CaO or $MnO_2$ as a melting-point depressant for desulfurization of molten iron is described in "Tetsu to Hagane (Transactions of the Iron and Steel Institute of Japan)", 21, No. 8, Aug. 25, 1935. A technique of simultaneous dephosphorization and desulfurization of molten iron is reported in supra, 64, No. 2, 1978 which uses about 25% (for the melt) of a low-melting $CaCl_2$-CaO-MnO flux prepared by melting a mixture of 70–80% $CaCl_2$, 10–20% CaO and 5–15% MnO. As is well known in the art, halides such as $CaCl_2$ melt at low temperatures and using them in large amount has the advantages of providing slag having low melting point and high fluidity. But the flux erodes the furnace refractory too much and emits noixous gases. Therefore, to put the reported technique into field operation, it must be supported by effective means of extending the life of the refractory lining of the refining furnace and by the system of collecting and treating the great volume of chlorine-containing gas emitted. In addition, the flux used in an amount of about 25% by weight of molten iron produces a huge amount of slag and poses the slag disposal problem.

Figure 2:
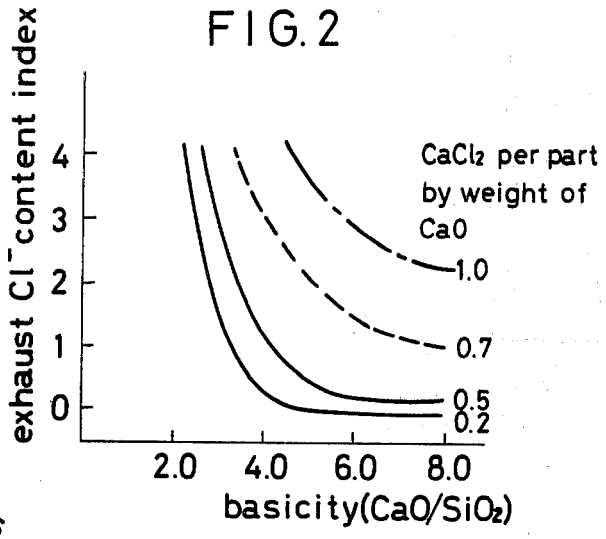
FIG. 2 is a graph illustrating the relationship between the basicity ($CaO/SiO_2$) of processing slag at various $CaCl_2/CaO$ levels in the second step and the Cl content index of refining exhaust gas.

It is essential that the flux used in the second step of the process of this invention comprise 0.2 to 0.5 parts by weight of KCl or $CaCl_2$ or both KCl and $CaCl_2$ per part by weight of CaO. The flux composition may comprise a mixture of these components or they may be used independently. The $CaCl_2$ in the flux has the effect of forming melting slag in low-FeO level from CaO at a bath temperature in the range of from 1380° to 1480° C. For accelerated formation of melting slag from CaO, the flux composition is desirably composed of grains 10 mm or less in size. The above described flux mainly consisting of CaO and $CaCl_2$ may have part of the $CaCl_2$ be replaced with $CaF_2$. If the flux contains less than 0.2 parts by weight of $CaCl_2$ (or KCl) per part by weight of CaO, it becomes difficult to form melting slag in low-FeO level which is highly reactive and fluid. Consequently, the flux preferably has a higher $CaCl_2$ (or KCl) content in order to accelerate the formation of melting slag and provide slag with the proper fluidity. However, if the $CaCl_2$ (or KCl) content exceeds 0.5 parts by weight based on CaO, the concentration of $Cl^-$ or $Cl_2$, i.e. HCl or evaporated $CaCl_2$ (or KCl) or chlorine-containing gases, in the exhaust gas is increased, as shown in FIG. 2, to thereby increase the load of a pollution control system or the like.

The ladle bath of the desiliconized molten iron is charged with 12–30 kg/t-pig of the flux described above (at the rate of 1.2–3.0% to an amount of molten iron). By means of the agitating or stirring force of the gas supplied from the gas blowing device 3, the flux is brought into sufficient contact with the molten iron to promote the reaction of melting slag formation until a processing slag having a basicity ($CaO/SiO_2$) between 3.5 and 8 is formed. The amount (basic unit) of the charge of the flux according to this invention is remarkably smaller than that indicated in supra, 64, No. 2, 1978 or that conventionally used in preliminary dephosphorization of various molten irons. The flux used in such a small amount is sufficient to achieve its intended results because of the combined effects of (1) desiliconization that has already been finished in the first step, (2) the processing slag is controlled to have a basicity between 3.5 and 8 and a T.Fe value between 3 and 10%, and (3) forced agitation or stirring of the molten iron bath.

Figure 3:
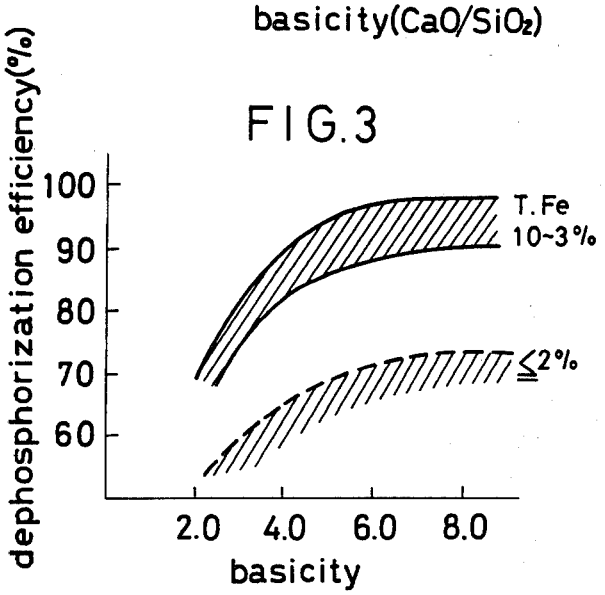
FIG. 3 is a graph illustrating the relationship between the basicity of processing slag at various T.Fe levels in the second step and the dephosphorization efficiency of molten iron.
Figure 4:
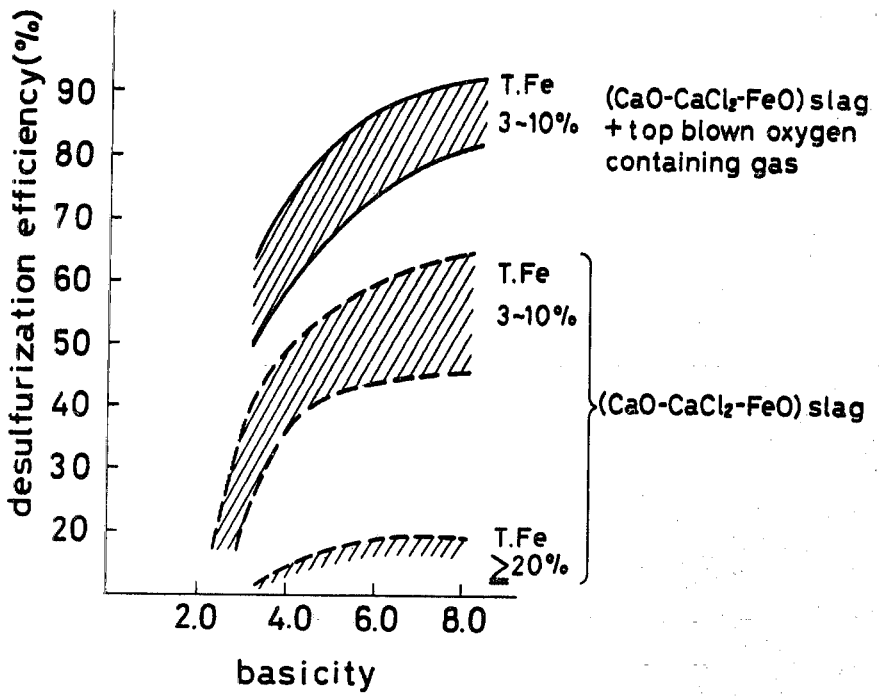
FIG. 4 is a graph illustrating the relationship between the basicity of processing slag at various T.Fe levels in the second step and the desulfurization efficiency of molten iron.

The desulfurization and dephosphorization occurring in the second step of this invention is characterized by not only the use of the flux mainly consisting of CaO and $CaCl_2$ (or KCl) but also the supply of solid oxygen or top blown oxygen or both types of oxygen until the molten iron contains not more than 0.025% of phosphorus, not more than 0.020% of sulfur, not less than 3.8% of carbon and a trace of silicon. Part of the solid oxygen and gaseous oxygen is used to form FeO that is consumed in dephosphorization. The relationship between the T.Fe level of the processing slag to be used in this invention and the dephosphorization efficiency is illustrated in FIG. 3 from which it can be seen that high efficiency of dephosphorization can be obtained by holding the T.Fe level of the slag at a value higher than 3%. The desulfurizing efficiency of said processing slag as correlated to the T.Fe level and the use of gaseous oxygen is shown in FIG. 4 from which one can see that high efficiency of desulfurization is achieved by reducing the T.Fe level of the slag to value lower than 10%. For these reasons, this invention limits the T.Fe level of the processing slag to the range between 3 and 10%. The basicisity of the slag is between 3.5 and 8, preferably between 4 and 6. One characteristic feature of the second step is that by blowing gaseous oxygen onto the surface of the processing slag, the oxygen is brought into contact with the sulfur imprisoned in the low-FeO fluid slag to gasify and dissipate the sulfur. Generally referred to as "evaporative desulfurization", this phenomenon is effective for regenerating the desulfurizing effect of the processing slag to assure high-effeciency desulfurization as of metal indicated in FIG. 4.

It is to be noted that the T.Fe level of the slag is the abbreviation for the total Fe in FeO and $Fe_2O_3$ in the slag and it does not include the metallic iron content. Because of the fast reduction rate of FeO and the resulting rapid change in the FeO content, it is impossible to control the T.Fe level between 3 and 10% by the conventional technique of charging all necessary portions of solid oxygen (iron oxides) at a time. As a result of studies on this problem, the inventors of this invention have found that the intended control of the T.Fe level can be accomplished by continuously supplying 15 to 30 kg/t of solid oxygen and/or 0.5 to 5.0 O $Nm^3$/t of top blown gaseous oxygen. It is to be understood that solid oxygen may be supplied in small quantities at a given interval. The advantage of such continuous or intermittent supply of gaseous oxygen or solid oxygen is that only small volumes of oxygen are needed in the second step, thus inhibiting the occurrence of decarburization with FeO; therefore, in combination with the effective inhibition of decarburization in the first step (desiliconization), the second step of this invention still provides molten iron whose carbon content is held at 3.8% or higher. This high-carbon molten iron enables a predetermined amount of scrap to be consumed in the third step and achieves a smooth decarburizing reaction to attain the proper tapping temperature. In addition, the silicon content of the molten iron is reduced to a trace through oxidation upon contact with the FeO in the processing slag, thus making it possible to perform slagless decarburization in the third step.

By making the slag contact the melt under agitation or stirring, the phosphorus content of the melt can be reduced to 0.025% or lower, and the sulfur content to 0.020% or lower. These values are those required by steel objects, and therefore, no further removal of phosphorus and sulfur is needed in the third step. The effectiveness of the desulfurization and dephosphorization is dependent on the efficiency of contact between the phosphorus or sulfur in the iron with the processing slag as provided by agitation or stirring with gas. If the agitating or stirring force of gas is not sufficient to provide the intended contact, other known agitating or stirring means such as an impeller may be employed either separately or in combination with the gas.

The second step of the steelmaking process of this invention has been described hereinabove by reference to the simultaneous desulfurization and dephosphorization using both a flux and an oxygen source. A modification of the step will now be described with regard to the production of molten iron having a still lower sulfur content. Basically, the modification consists of desulfurization that precedes dephosphorization: first, a flux mainly consisting of CaO and $CaCl_2$ is charged into the molten iron under agitation or stirring to perform high-degree desulfurization accompanied by formation of CaO-containing melting slag, and subsequently, the molten iron which still contains the flux is supplied with both solid oxygen and top blown gaseous oxygen to maintain the T.Fe level of the processing slag between 3 and 10% to carry out desulfurization wherein the slag is subjected to evaporative desulfurization to prevent resulfurization of the molten iron (i.e. the sulfur in the slag will not re-enter the melt). After completion of the treatments in the second step, the processing slag is cut off. The absolute amount of said processing slag is remarkably small, thus causing only a small iron loss. The slag contains about 10% to $P_2O_5$ and also other effective ingredients and can be regenerated for use as a phosphate-containing complex fertilizer. This means that almost all of the slag formed in the second step can be applied to useful purposes.

The third step

The third step of the steelmaking process of this invention is decarburization of the molten iron which has a carbon content higher than 3.8% but whose silicon, sulfur and phosphorus contents have been reduced in the first and second steps to the levels required by steel objects. As is illustrated in the right drawing of FIG. 1, the third step of this invention is carried out either within the ladle 2 that has been used in the previous two steps or within a decarburizing furnace 7 after transferring the treated melt into the furnace. The decarburizing furnace 7 may be a basic oxygen converter, oxygen bottom blowing converter, or any other conventional type. No $SiO_2$ is formed even if oxygen is blown into the ladle 2 or decarburizing furnace 7 during decarburization. Therefore, one characteristic feature of the decarburization performed in the third step of this invention is blowing of oxygen without using CaO or any other refining flux. The most characteristic feature of the third step is that a gas is blowing into the ladle 2 or decarburizing furnace 7 from the bottom to agitate or stir the bath of molten iron vigorously, while oxygen gas is soft-blown onto the surface of the bath.

When an oxygen jet is blown at a fast rate as in the basic oxygen converter, a cavity is formed in the surface of the metal bath. In the steelmaking industry, the intensity of oxygen blowing is expressed by several indices, and one typical index is L/Lo (wherein L is the depth of the cavity and Lo is the depth of the bath, both being in millimeters). The value L is determined by for example the following formulae (1) and (2)*:

$$L = L_h \cdot \exp(-0.78/L_h) \quad (1)$$

$$L_h = 63.0(kFo_2/nd) \quad (2)$$

wherein $L_h$ is the depth of cavity when the distance between lance and metal bath (h) is 0, $Fo_2$ is the oxygen blowing rate ($Nm^3$/hr), n is the number of nozzle orifices, and d is the nozzle diameter (mm). Blowing with high L/Lo is generally referred to as hard blowing, and that with a low L/Lo soft blowing. For the ordinary basic oxygen converter process, the value of L/Lo is between about 0.7 and 0.9.

*Kiyoshi Segawa; Tetsu Yakin Hanno Kogaku (Ferrous Metallurgical Engineering), published by Nikkan Kogyo Shinbunsha, 1969.

If the value L becomes large, much spitting of the metal occurs. If L is decreased to suppress the phenomenon, insufficient agitation or stirring retards the reduction of the oxidized surface of the bath with carbon, thus forming a great amount of FeO-MnO slag over the surface of the melt bath. This not only causes a great iron loss but excessive attack of the slag on the refractory. If L/Lo is increased for the purpose of suppressing the formation of FeO-MnO slag when the ratio of metal volume to furnace capacity is great, or the depth of metal bath (Lo) is great as in this invention, the necessity arises to increase the absolute value of L considerably, which means, as mentioned above, extreme spitting, and more than that, the making of such deep cavity is very difficult in actual operations.

To overcome these difficulties, the inventors of this invention tried to promote the reduction with carbon of the FeO-MnO slag formed over the surface of the metal bath by means of a gas blown from the bottom of the bath rather than by the oxygen jet blown over the bath as in the basic oxygen converter, and have found that such method is effective for suppressing the formation of FeO-MnO slag irrespective of the L/Lo level. Therefore, the depth of cavity that must be formed by oxygen gas supplied from above the bath is not critical to this invention, and any value can be selected that does not cause spitting. In consequence, it has now become possible to accomplish slag-free decarburization under soft blowing where L/Lo is between about 0.1 and 0.6.

Figure 5:
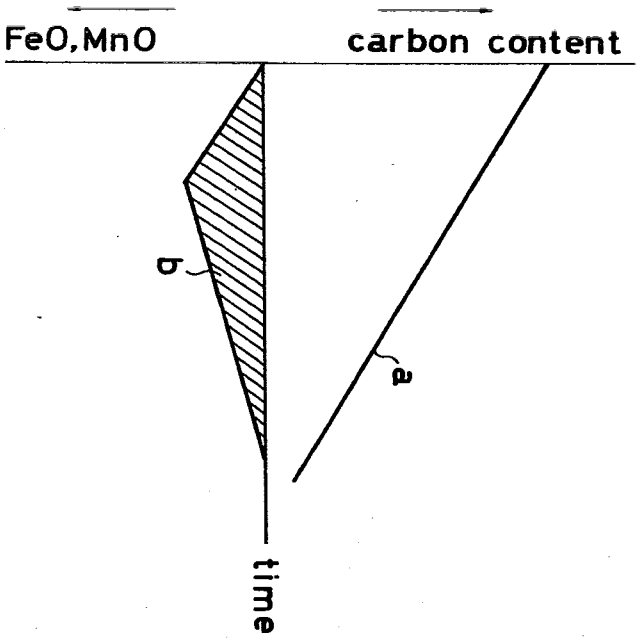
FIG. 5 is a graph illustrating the time-dependent change of FeO and MnO that formed during decarburization in the third step.

The soft blowing of oxygen helps inhibit the occurrence of spitting during blowing. Decarburization follows the curve a of FIG. 5 from which it is clear that in the early stage of blowing, part of the oxygen supplied is used to oxidize the molten iron producing a temporary buildup of FeO and MnO as indicated, by the shadowed portion b. However, firstly, due to the combustion of the imprisoned carbon that has been saved in a sufficient amount to be used as a heat source, the bath temperature is elevated to accelerate the rate at which FeO and MnO formed are reduced, and secondly, agitation or stirring of the bath helps FeO and MnO be consumed through reduction with the imprisoned carbon. Therefore, it can safely be concluded that almost all of the oxygen supplied contributes to the decarburization in the third step. The absence of unwanted phenomena such as slag foaming and splashing leads to smooth decarburization in the ladle 2 and decarburizing furnace 7, and as a result, the intended final carbon content can be obtained with good controllability and without forming any slag to be discharged.

According to the above described third step of this invention, effective use of the decarburizing furnace can be realized. In the conventional converter process, to avoid the potential hazards of slag foaming and splashing, the converter can receive molten iron that accounts for only about 15% of its capacity, but according to this invention, this value is increased to 25 to 60% of the capacity of the ladle or decarburizing furnace, leading to the use of a smaller decarburizing vessel and achieving a marked decrease in the equipment cost. Furthermore, if an iron or manganese source is added to the bath of the melt in the reducing region of FeO and MnO that is determined by the force of agitating or stirring the bath and the bath temperature, the process of this invention is free from FeO or MnO foaming. The yield of the charge of iron or manganese source is very high because both FeO and MnO are consumed through reducing reaction. As further advantages, the process not only permits easy control of decarburization and the tapping temperature but it also achieves an even more reliable conditioning of steel components. In the process of this invention, if the blowing has passed its initial period, or stated specifically, if the bath temperature becomes relatively high (e.g. 1500° C. or more) and the reduction rate becomes fast in relative terms, more of the gas is supplied to the bottom of the molten iron to enhance the forced agitation of bath by the bubbling action of the gas. By so doing, an even higher efficiency of contact is provided between the oxygen supplied or the resulting FeO/MnO and the imprisoned carbon, thus suppressing noticeably the formation of FeO and MnO or making them disappear as soon as they are formed.

Alternatively, the jet of oxygen is hard-blown over the surface of the melt without supplying an agitating or stirring gas from the bottom. This method also agitates or stirs the bath sufficiently to provide the adequate contact between the imrpisoned carbon and the oxygen supplied for achieving the intended smooth decarburizing reaction. In the manner described above, the third step of this invention performs decarburization in the ladle 2 or the furnace 7 to burn the imprisoned carbon effectively for elevating the bath temperature. During the decarburization, a predetermined amount of scrap is consumed while the intended tapping temperature is attained and, in addition, the proper control of said tapping temperature can be achieved.

As described in the foregoing, the steelmaking process of this invention consists of the sequence of the three steps of processing molten iron, i.e. desiliconization, desulfurization/dephosphorization, and decarburization; the process is batchwise and each step is performed in one ladel or the molten iron may be transferred into a separate decarburizing furnace. As a result, the content of each target component can be reduced to the desired level under the optimum conditions of each step while the proper conditions are provided for the next step.

Since the slag formed in one step is always discharged before carrying out the next, reliable slag cut-off is provided, thus achieving the desired refining in each step with minimum slag formation.

Although two kinds of slag are discharged between each step, they are discharged separately and in small amounts. Therefore, they can be applied to valuable uses where their characteristics are exhibited to the fullest, which also means a very limited slag disposal.

The process of this invention is now described in greater detail by reference to the following examples which are given here for illustrative purposes only and are by no means intended to limit the scope of the invention.

EXAMPLE 1

A ladle equipped with a gas bubbling device was charged with 10 t of molten iron containing 4.5% C, 0.53% Si, 0.110% P and 0.036% S. While the molten iron in the ladle was agitated or stirred with nitrogen gas, 5 $Nm^3/t$ of oxygen gas and 15 kg/t of iron ore were supplied to the molten iron to reduce the Si content to 0.14%. The desiliconization was stopped at a bath temperature of 1450° C. and about 20 kg of $SiO_2$-based slag was discharged. Subsequently, the ladle was supplied with 20 kg/t of a flux containing 0.3 parts by weight of $CaCl_2$ per part by weight of CaO, 25 kg/t of iron oxides and 2.2 $Nm^3/t$ of oxygen gas, and the molten iron was agitated or stirred with an impeller for a period of 10 minutes to perform simultaneous desulfurization and dephosphorization. The iron oxides were charged intermittently in four portions with a 2-minute interval between each charge. The resulting slag had a basicity ($CaO/SiO_2$) of 3.9 and a T.Fe level of 4%.

The above procedures produced molten iron containing 3.86% of C, a trace of Si, 0.018% of P and 0.017% of S. About 35 kg of slag was formed and discharged thoroughly. The slag-free molten iron was transferred to a converter type decarburizing furnace where it was subjected to slag-free decarburization with 32 $Nm^3/t$ of an oxygen jet being supplied to produce molten steel containing 0.08% C, 0.18% Mn, 0.016% P and 0.017% S. The temperature at the end of the decarburization was 1380° C.

The above described steelmaking process produced about 20 kg/t of slag in the desiliconizing step, about 35 kg/t of slag in the desulfurizing and dephosphorizing step, and no slag in the decarburizing step. The total was about 55 kg/t, less than the half of the amount produced in the conventional converter process. Virturally all of the slag formed in the desiliconizing step was used as an additional $SiO_2$ for sintered ore, whereas the slag formed in the desulfurizing and dephosphorizing step was crushed and the iron grains were removed from the slag so that more than about 80% of the slag could be used as a fertilizer. The slag that was dumped was a little over about 5 kg/t.

EXAMPLE 2

Figure 6:
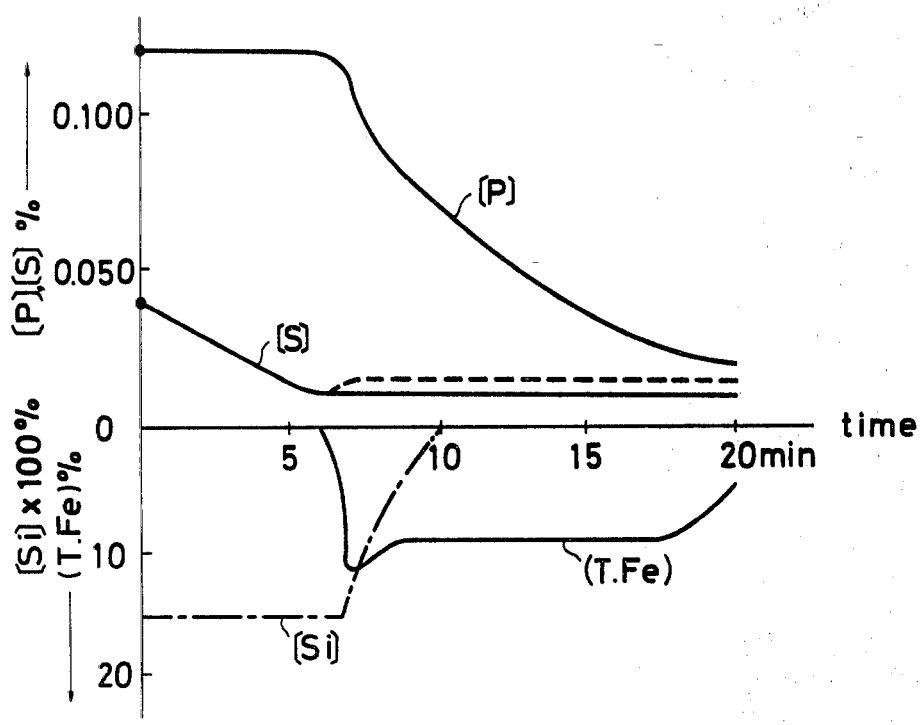
FIG. 6 is a graph illustrating the time course of desulfurization and dephosphorization as effected in the second step of Example 2 that will be described hereunder.

FIG. 6 visualizes the profile of processing molten iron in this Example. A hundred tons of molten iron in a ladle having a temperature of 1400° C. and which was desiliconized as in Example 1 to reduce the Si content to 0.15% were charged with 18 kg/t of a flux containing 0.3 parts by weight of $CaCl_2$ per part by weight of CaO to effect desulfurization under forced agitation or stirring by means of gas bubbling. The S content in the molten iron which was initially 0.040% was reduced to 0.008% in 6 minutes. Subsequently, the melt was supplied with 21 kg/t of iron oxides and 2 $Nm^3/t$ of oxygen gas. A quarter of the iron oxides was charged 6 minutes after the commencement of desulfurization, and the remaining three quarters were charged in three portions with a 2-minute interval between each charge. The oxygen gas was supplied continuously at a predetermined rate. At the end of the dephosphorization (20 minutes later) the refining slag had a basicity ($CaO/SiO_2$) of 4.5. The T.Fe level of the slag varied just after the supply of the oxygen source, but it was generally held at 9% and was 4% at the end of the dephosphorization. The phosphorus content in the molten iron was held at 0.12% throughout the desulfurization (for the first 6 minutes) but thereafter, it was rapidly decreased to become 0.020% at the end of the dephoshorization. The desulfurization efficiency and dephosphorization efficiency of the process were 80% and 83.3%, respectively. The thus processed molten iron had a temperature of 1330° C. The molten iron was then decarburized in the same manner as Example 1. Molten steel of the following composition with a very low sulfur content was provided:

C: 0.06%, Mn: 0.20%, P: 0.020%, S: 0.008%

A total of about 50 kg/t-pig of slag was discharged from the above procedure, and this value was not much different from that obtained in Example 1.

EXAMPLE 3

Molten iron from a blast furnace which contained 4.5% C, 0.60% Si, 0.130% P and 0.038% S was desiliconized, dephosphorized and desulfurized as in Examples 1 and 2 to have the C, Si, P and S contents reduced to 4.2%, a trace, 0.021% and 0.010%, respectively. The resulting melt had a temperature of 1360° C. Two ladle-like decarburizing furnaces each having an internal capacity of about 4.4 $m^3$ were charged with 10 t (a space factor of about 32%) and 15 t (about 49%) of the molten iron, onto the surface of which was softblown 39 $m^3/t$ of oxygen gas while 0.3 $m^3/t$ of nitrogen gas was supplied to the melt from the porous plug recessed in the bottom of the decarburizing furnace. A given amount of scrap was also charged into the melt as a coolant. Throughout the decarburizing procedure, no flux was added. After the initial stage of decarburization, the blowing was suspended and the inside of the furnace was visually observed; a small amount of slag floated on the surface of the metal bath. The blowing was resumed and continued until molten steel having a carbon content of 0.05% was produced in each furnace. Visual inspection of the inside of the furnace indicated no formation of slag. Some degree of spitting occurred during oxygen blowing but no metal was thrown up to the outside of the furnace.

As is clear from the above description, in Example 3, molten iron with reduced Si, P and S contents was placed in a ladle-like decarburizing furnace in a volume accounting for 32 or 49% of the furnace capacity, and oxygen was soft-blown over the surface of the melt under forced agitation or stirring in the absence of any kind of flux. The fact that the process did not cause slag foaming or slopping means that a decarburizing furnace far smaller in size than is conventionally required can be used.

The process can comprise, consist essentially of or consist of the steps set forth and the compositions employed can consist essentially of or consist of the materials set forth.

What is claimed is:

1. A steelmaking process for desiliconizing, dephosphorizing, desulfurizing and decarburizing molten iron from a blast furnace, comprising the following sequence of steps:

(1) a first step of agitating the molten iron in a vessel, supplying the molten iron with both gaseous oxygen and, an iron oxide contanitive material reducing the Si content in the iron to a value between 0.05 and 0.20% at a controlled bath temperature between 1480 and 1480° C., and discharging the resulting slag;

(2) a second step of agitating the molten iron from the first step having a bath temperature between 1380° and 1380° C., supplying the molten iron with a flux consisting essentially of CaO and 0.2 to 0.5 parts by weight of $CaCl_2$ or KCl or both $CaCl_2$ and KCl per part by weight of CaO and a source of oxygen, maintaining the basicity of the processing slag between 3.5 and 8.0 and the T.Fe value between 3 and 10%, desulfurizing and dephosphorizing the iron with the same slag to reduce the P, S and Si contents to no higher than 0.025%, 0.020% and a trace, respectively, and to hold the C content not lower than 3.8%, and discharging the resulting slag; and (3) a third step of decarburizing the molten iron from the second step by blowing oxygen onto the melt without using a refining flux.

2. A process according to claim 1 wherein the source of oxygen used in the second step consists of both gaseous oxygen and iron oxide containing material.

3. A process according to claim 1 wherein the charge of said flux used in said second step is in the range of from 12 to 30 kg per ton of molten iron.

4. A process according to claim 1 wherein said oxygen source is supplied continuously to control the T.Fe level of the processing slag in said second step.

5. A process according to claim 1 wherein the processing slag has a basicity between 4 and 6 in said second step.

6. A process according to claim 1 wherein the gaseous oxygen used in the second step is blown onto the surface of the processing slag to perform evaporative desulfurization.

7. A process according to claim 1 wherein the molten iron is agitated in the second step while a flux consisting essentially of CaO and $CaCl_2$ or KCl or both $CaCl_2$ and KCl is supplied to the molten iron to perform desulfurization first, followed by dephosphorization occurring simultaneously with evaporative desulfurization of the processing slag.

8. A process according to claim 1 wherein gaseous oxygen is soft-blown onto the surface of the molten iron bath in the third step and an agitating gas is supplied from the bottom of the bath.

9. A process according to claim 8 wherein in the third step, the vessel is charged with molten iron that accounts for 25 to 60% of the vessel capacity.

10. A process according to claim 8 wherein the source of oxygen used in the second step consists of both gaseous oxygen and iron oxide containing material, the charge of said flux used in said second step is in the range of from 12 to 30 kg per ton of molten iron, and the processing slag has a basicity between 4 and 6 in said second step.

11. A process according to claim 10 wherein the control of the total iron level is accomplished by supplying either (a) 15 to 30 kg/ton of iron oxide containing material, (b) 0.5 to 5.0 $Nm^3$/ton of top blown gaseous oxygen or (c) both 15 to 30 kg/ton of iron oxide containing material and 0.5 to 5.0 $Nm^3$/ton of top blown gaseous oxygen.

12. A process according to claim 1 wherein the control of the total iron level is accomplished by supplying either (a) 15 to 30 kg/ton of iron oxide containing material, (b) 0.5 to 5.0 $Nm^3$/ton of top blown gaseous oxygen or (c) both 15 to 30 kg/ton of iron oxide containing material and 0.5 to 5.0 $Nm^3$/ton of top blown gaseous oxygen.

13. A process according to claim 1 wherein said oxygen source is supplied portionwise to control the T.Fe level of the processing slag in said second step.

14. A process according to claim 1 wherein the iron oxide containing material is selected from the group consisting of iron ore, iron-manganese ore, scales and iron oxides or mixtures thereof.

15. A process according to claim 14 wherein the iron oxide containing material is iron ore.

16. A process according to claim 14 wherein the iron oxide containing material is iron-manganese ore.

* * * * *

UNITED STATES PATENT AND TRADEMARK OFFICE

CERTIFICATE OF CORRECTION

PATENT NO. : 4,295,882

DATED : October 20, 1981

INVENTOR(S) : ARIMA, Ryoji; UMEZAWA, Kazushige; and NISUGI, Tokuzo

It is certified that error appears in the above-identified patent and that said Letters Patent is hereby corrected as shown below:

IN THE CLAIMS:

Claim 1, line 7 of the claim change "contanitive" to "containing".

Claim 1, line 10, second occurence, change "1480" to "1380".

Claim 1, line 13, change "1380" to "1480".

Signed and Sealed this

*Thirty-first* Day of *August 1982*

[SEAL]

*Attest:*

GERALD J. MOSSINGHOFF

*Attesting Officer*

*Commissioner of Patents and Trademarks*